United States Patent [19]

Place

[11] Patent Number: 4,604,603

[45] Date of Patent: Aug. 5, 1986

[54] DUAL TEMPERATURE THERMOSTAT

[75] Inventor: Donald E. Place, Mansfield, Ohio

[73] Assignee: Therm-O-Disc, Incorporated, Mansfield, Ohio

[21] Appl. No.: 736,297

[22] Filed: May 20, 1985

Related U.S. Application Data

[63] Continuation of Ser. No. 590,377, Mar. 16, 1984, abandoned.

[51] Int. Cl.[4] ..... H01H 37/48

[52] U.S. Cl. ..... 337/394; 337/392

[58] Field of Search ..... 337/394, 383, 128, 382, 337/393, 386, 139, 392

[56] References Cited

U.S. PATENT DOCUMENTS

| | | | |
|---|---|---|---|
| 2,924,700 | 2/1960 | Huffman | 337/392 |
| 3,732,518 | 5/1973 | Them et al. | 337/394 |
| 3,906,424 | 9/1975 | Clancy et al. | 337/394 |
| 3,909,592 | 9/1975 | Eide | 219/462 |
| 3,921,198 | 11/1975 | Pohl | 337/343 |
| 4,135,081 | 1/1979 | Fischer | 219/449 |
| 4,215,332 | 7/1980 | Wharton | 337/394 |
| 4,350,875 | 9/1982 | McWilliams | 219/449 |
| 4,371,780 | 2/1983 | Gossler et al. | 219/446 |
| 4,400,679 | 8/1983 | Snider | 337/382 |
| 4,544,831 | 10/1985 | Bayer | 219/449 |
| 4,555,688 | 11/1985 | Bayer | 337/394 |

FOREIGN PATENT DOCUMENTS

| | | | |
|---|---|---|---|
| 1277848 | 6/1972 | United Kingdom | 337/394 |

*Primary Examiner*—Harold Broome

*Attorney, Agent, or Firm*—Pearne, Gordon, Sessions, McCoy, Granger & Tilberry

[57] ABSTRACT

A dual temperature probe-type thermostat is illustrated in which a rod and tube probe is mounted at one end with a swivel on the switch body. The swivel structure is simplified to provide a bearing member engaged and positioned by the rod during swiveling movement. Both switches are operated by a single operator which is guided and positioned solely by the switches themselves. One switch is provided with a calibration cam to eliminate any need for selective assembly.

18 Claims, 4 Drawing Figures

DUAL TEMPERATURE THERMOSTAT

This is a continuation of application Ser. No. 590,377 filed Mar. 16, 1984, now abandoned.

BACKGROUND OF THE INVENTION

This invention relates generally to thermostats, and more particularly to a novel and improved dual temperature thermostat particularly suited for use with smooth top cooking ranges.

PRIOR ART

Smooth top ranges generally provide a single, smooth cooking surface in combination with a plurality of separate and spaced heating elements positioned below such smooth surface. Such smooth top is formed of a glass material or of other suitable material capable of withstanding substantial temperatures. Because a single flat top is provided, an attractive appearance can be obtained and the cooking surface can be relatively easily cleaned. In use, the utensil is positioned on the flat top over the selected heater, and is heated through the glass or other materials on which is rests.

It is also known to install a rod and tube probe-type thermostat to sense the temperature at the respective cooking locations. Such thermostat is often installed to operate as a high limit device to prevent overheating and damage to the flat top. Examples of such devices are illustrated in U.S. Pat. Nos. 3,732,518; 3,909,592; 4,135,081; 4,215,332; 4,350,875; 4,371,780; and 4,400,679, some of which are assigned to the assignee of the present invention.

It is also known to provide a separate thermostat to sense the temperature of the flat top and to operate a warning light whenever a predetermined relatively low temperature (e.g., about 150° F.) exists. Such warning light, usually referred to as a "hot light," indicates to the user that a burn can result if the flat top surface is touched.

Such hot light is turned on when the surface is heated to the predetermined temperature, and remains on, even after the heater is turned off, until the surface cools below such predetermined temperature.

Generally, the thermostat which acts as a high limit is separate from the thermostat which operates the hot light. However, it is known to provide a combined thermostat in a single unit.

Such rod and the probe type thermostats often employ a glass tube combined with a metal rod extending through the tube. The metal and glass are selected to provide substantially different coefficients of thermal expansion so that the probe provides a good temperature sensing switch actuator. Further, in many cases, the probe is mounted on the thermostat body with a swivel-type connection, allowing the probe to be moved with respect to the body to a desired position in the overall combination. Several of the patents cited above disclose such rod and the tube probe-type thermostats utilizing a glass tube and a metallic rod in which the probe is supported on the switch body with a swivel-type connection.

SUMMARY OF THE INVENTION

There are several important aspects to the present invention. In accordance with one important aspect of the invention, a novel and improved swivel structure is provided for mounting the rod and tube probe-type sensor on a switch body of a thermostat. Such thermostat is particularly suited for use in combination with flat top ranges.

In accordance with other important aspects of this invention, novel and improved combination high limit and hot light type thermostats are provided in which a single operator or bumper operates separate switches at two widely different temperatures.

In the illustrated embodiment, such device provides two snap-acting type switches, one of which is structured to withstand substantial overtravel without damage. Further, the single operator or bumper is actually supported and positioned by the switches themselves. Since the switch body, in order to withstand the substantial temperatures involved, is formed of a ceramic-type material, the support of the bumper or operator by the switches eliminates the need for the use of the ceramic material itself as a guiding structure.

Further, in the illustrated embodiment, means are provided to calibrate at least one switch with respect to the other switch and to calibrate the probe with respect to the switches so that accurate temperature response is achieved with both switches without the requirement for selective fitting of the parts of the assembly.

These and other aspects of this invention are illustrated in the accompanying drawings, and are more fully described in the following specification.

DETAILED DESCRIPTION OF THE DRAWINGS

Figures 1, 4:
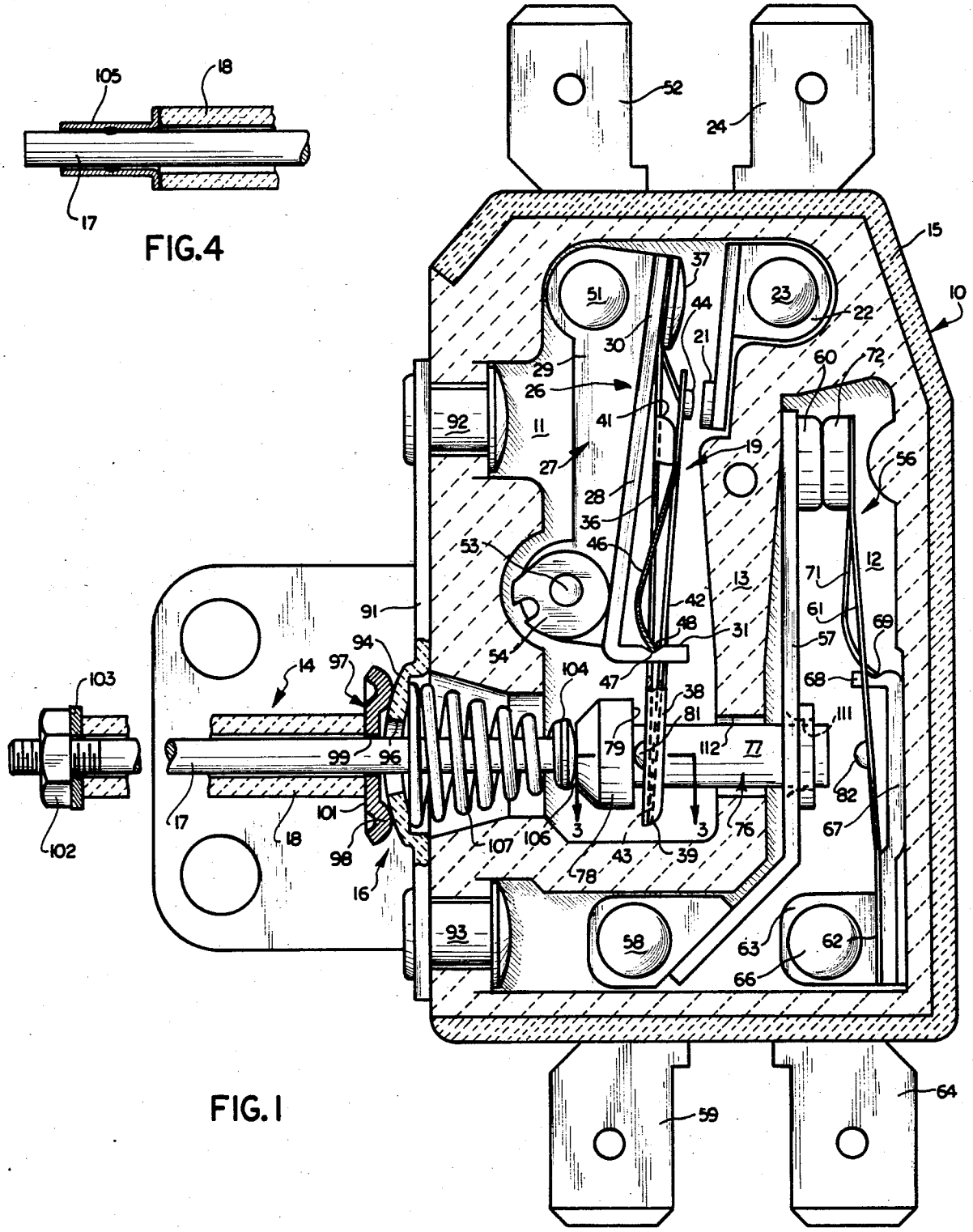
FIG. 1 is a side elevation, in cross section, of a thermostat incorporating the present invention, with the cover removed to illustrate the structure of the switches and the calibration structure and mounting structure of the probe.
FIG. 4 is a fragmentary cross section of a second embodiment in which calibration is provided by a sleeve positioned on the free end of the rod and then welded in position.
Figure 2:
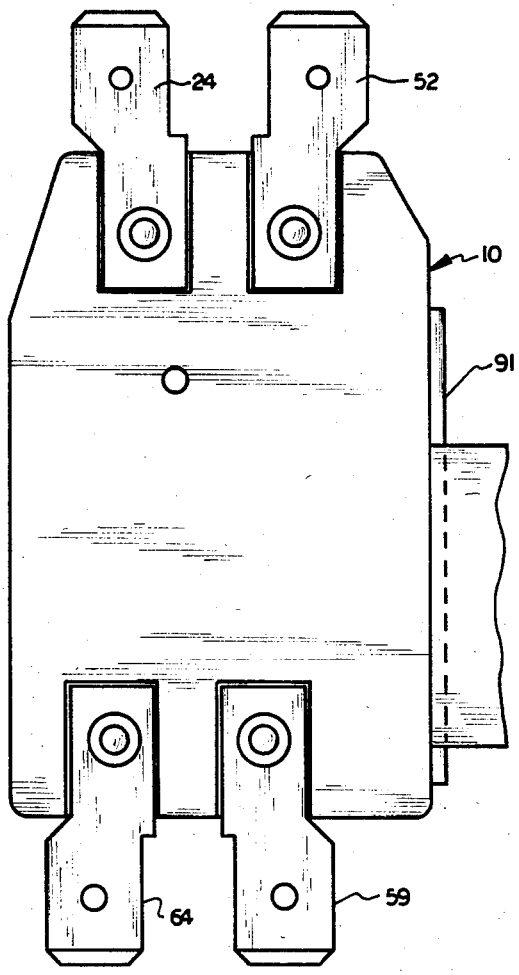
FIG. 2 is a view of the body, taken from the opposite side from the view of FIG. 1.

In the illustrated embodiment, the thermostat is provided with a body 10 which cooperates with a cover (not illustrated) to define first and second switch chambers 11 and 12, respectively. In FIG. 1 the interior portion of the body is illustrated in section along the centrl plane of switches. An integral wall 15 projects above such plane and is indicated with different sectioning for purposes of illustration. The two switch chambers 11 and 12 are separated by an integral body wall 13. Preferably, the body 10 is formed of a ceramic material because of the relatively high temperatures encountered when the device is installed in a flat top range to sense the operating conditions adjacent to the associated heater. U.S Pat. No. 4,350,875 disclose one arrangement for locating the thermostat adjacent to a heater, and such Letters Patent are incorporated herein by reference for such disclosure.

A rod and tube-type probe assembly 14 is supported at one end by a swivel mount 16, as discussed in greater detail below. The probe 14 includes a rod 17 and a tube 18, through which the rod extends. Generally, the tube is formed of a glass-type material, and the rod is formed of a metal, with the particular materials forming the rod and tube being selected so that they have substantially different coefficients of thermal expansion. Therefore, when the rod and tube are heated, differential expansion occurs, and such differential expansion causes the operation of the switches.

A first switch 19 is mounted in the first switch chamber 11, and includes a fixed contact 21 carried by a fixed contact support 22. The fixed contact support 22 is mounted on the body 10 by a rivet 23, which extends through the wall of the body 10 and connects the fixed contact support 22 to a first terminal 24. The movable contact assembly 26 includes a contact support 27. Such contact support includes an integral arm 28 joined to a base portion 29 at one end 30 and extending along a plane which is generally perpendicular to the plane of the base portion 29. Such arm, although formed integrally with the base portion 29, is notched to separate it from the base portion except at the end 30. Consequently, the arm 28 is cantilever-supported by the base portion 20 on the contact support 26. The free end of the arm 28 is bent to provide a lateral projection 31.

Mounted on the contact support 27 is a movable arm 36 extending in cantilever fashion from a mounting rivet 37 which secures one end of the movable arm 36 to the contact support 26. The movable arm 36 is formed of a spring material, and is provided with laterally extending stiffening flanges 38. Such stiffening flanges extend from the free end 39 of the movable arm 36 to a location at 41 spaced a small distance from the rivet 37. Consequently, the movable arm 36 is substantially rigid throughout most of its length, and moves with a hinge-like pivotal movement by bending of the short portion thereof between the end of the flanges at 41 and the rivet 37.

A movable contact support 42 is welded at one end 43 to the free end of the movable arm 36 and extends back along the movable arm to its free end, where a movable contact 44 is mounted. Here again, the movable contact support 42 is formed of a spring material. Further, the movable contact support 42 is formed with an integral, central leg 46, which is deflected from its unstressed condition to position its end 47 in a notch 48 formed in the lateral projection 31.

The central leg 46 functions to place the movable arm 36 in compression and the contact support 42 in tension and creates a spring system, causing the switch 19 to move with snap action when it opens and closes. Operation of the switch 19 is controlled by the position of the notch 48 with respect to the free end 39 of the movable arm. When the free end 39 is moved to the right as viewed in FIG. 1 past a predetermined snap position, the spring force created by the central leg 46 causes the movable contact 44 to move into engagement with the fixed contact 21 with a snap action. Conversely, when the free end 39 moves in the opposite direction past the snap point, the movable contact 44 moves away from the fixed contact 21 with snap action.

This general type of which 19 is more fully disclosed and claimed in the U.S. Pat. No. 4,400,679, and such patent is incorporated herein by reference to provide a more complete description of the structure and function of the switch 19. The switch 19 is particularly suited for the present combination because it can withstand substantial overtravel after the switch closes without any damage to the switch, or without any change in its calibration.

The base portion 29 of the first switch 19 is mounted within the body 10 by a rivet 51 which also connects the base portion to a second terminal 52. A second mounting rivet 53 secures the other end of the base portion 29 to the body 10, and also provides a pivot shaft extension on which a calibration cam 54 is mounted. The calibration cam 54 can be pivoted with respect to the rivet 53 to adjust the position of the notch 48 and thereby adjust the position of the end 39 when the switch actually opens or closes. After the adjustment is completed as discussed below, an adhesive is applied to the cam and rivet to permanently lock the same in the adjusted position.

A second snap-acting switch 56 is mounted in the second switch chamber 12 and includes a fixed contact support 57 mounted at one end by a rivet 58 which connects to a third terminal 59. Mounted at the other end of the fixed contact support is a fixed contact 60.

A movable contact support 61, formed of spring material, is welded at its mounting end 62 to a support element 63. Such support element is secured to the body 10 and connected to a fourth terminal 64 by a rivet 66. The mounting element is also provided with an arm 67 which extends along the movable contact support 61 to a lateral projection 68, providing a notch 69. The movable contact support is cut out to provide a central leg 71 which provides a free end positioned in the notch 69 and sized so that it is deflected from its unstressed condition so as to place the movable contact support arm 61 in tension. The free end of the movable contact support arm is provided with a movable contact 72 which moves into and out of engagement with the fixed contact 60 when the switch operates. The central leg 71, which places the movable contact support arm 61 in tension, creates a spring system which causes the switch 56 to open and close with snap action.

Figure 3:
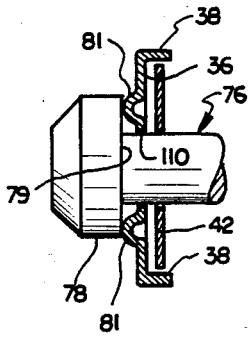
FIG. 3 is a fragmentary cross section taken along line 3—3 of FIG. 1, illustrating the manner in which one end of the switch operator is positioned by the hot light switch.

Referring to FIGS. 1 and 3, a single bumper or switch operator 76 operates both of the switches. Such bumper is formed with a cylindrical shank 77 and an enlarged, circular head portion 78 which provides a radial face 70 engageable with dimples 81 formed on the movable arm 36. The end of the shank 77 is movable into engagement with a dimple 82 on the movable contact support arm 61 to operate the second switch 56. With this structure, a single bumper operates both of the switches 19 and 56, as discussed below.

The swivel mounting includes a bracket 91 mounted on one side of the body 10 by a pair of spaced rivets 92 and 93. A portion of the bracket 91 is deformed to provide a curved surface 94 having a uniform radius of curvature. Such curved surface is a portion of a sphere. Centrally located in the curved portion 94 is a clearance opening 96 through which the rod 17 projects with substantial clearance. A simple bearing member 97 is provided with a circular projection 98 which seats against the curved surface 94 around the opening 96. Such bearing member provides a central opening 99 through which the rod 17 fits with relatively close clearance and a central planar portion 101 around the central opening 99 against which the end of the tube 18 is seated.

At the remote end of the probe 14, the rod 17 is threaded to receive a nut 102. Positioned between the nut 102 and the other end of the tube 18 is a washer 103. The nut 102 permits adjustment of the position of the rod 17 with respect to the tube 18 and provides a simple mechanism for calibrating the device, as discussed below.

The inner end of the rod 17 is provided with an enlarged head or output portion 104 engageable with a radial surface 106 on the bumper 76. Positioned between the head 104 and the bracket 91 is a conically wound coil spring 107 which operates to urge the rod 17 toward the bumper 76 and, in addition, functions to maintain the tube 18 properly seated against the bearing members 97 and washer 103. Further, such spring also functions to maintain the bearing member 97 in engagement with the curved surface 94.

In operation, the thermostat is installed so that the probe 41 projects between the flat top of the range and the heating element so as to sense the temperature in such zone.

When the heater is turned on, the temperature of the probe increases, causing the tub 18 and the rod 19 to increase in temperature. This causes the rod 17 to expand longitudinally more than the tube 18, due to the differences in coefficients of thermal expansion of the material forming the rod and the tube. Consequently, the spring 107 causes the head 104 and the bumper 76 to move to the right, as viewed in FIG. 1. The switch 119 is calibrated so that movement of the free end 39 to the right causes the switch 19 to close when a temperature in the order of about 120° to 150° F. is reached. Closure of the switch 19 energizes the hot light, to indicate to the user of the range that the surface portion of the flat top is at a temperature which could cause a burn-type injury if touched.

It should be noted that a substantial spacing exists between the end of the bumper 76 and the dimple 82, so the switch 56 remains closed as the temperature of the probe and, in turn the temperature of the flat top adjacent the heater, increases. Consequently, the heater continues to be energized, and the temperature continues to increase.

In the event that the probe senses a temperature at the high limit of temperatures desired for the unit, e.g., about 1050° to 1300° F., the differential expansion between the rod 17 and the tube 18 is sufficient to cause the end of the bumper 76 to move into engagement with the rib 82 and causes the switch 56 to open. Such switch is connected in the heater circuit so that when such high limit temperature is reached, the heater is shut off until the temperature sensed by the probe drops below the high limit temperature, at which time the heater can be again energized by closure of the switch 56. The switch 56 can function to cycle and regulate the temperature at the operating temperature of that switch. The operating temperature of the switch 56 is selected so that damage does not occur to either the heater or the flat top of the range.

Normally, a separate regulating switch (not illustrated) is provided which is adjusted by the user, allowing the user to regulate the temperature of the heater or any desired temperature below the high limit temperature so as to control the cooking rates.

When the heater is turned off, the flat top and the heater unit cool gradually, causing the differential contraction of the probe, which functions to move the bumper 76 to the left as viewed in FIG. 1. When the temperature sensed by the probe drops down to the calibration temperature of the switch 19, such switch opens to shut off the warning or hot light, indicating that the danger of injury no longer exists.

The movable arm 36 is biased toward the switch open position so as to maintain the bumper 76 against the head 104 during such cooling operation and to cause the switch 19 to open when sufficient cooling has occurred.

In the particular embodiment illustrated, the calibration of the high limit switch 56 may be established by adjusting the nut 102 with respect to the rod 17, and the calibration of the operating temperature of the switch 19 may be established by adjustment of the cam 54. Therefore, with such embodiment it is possible to separately calibrate the two switches by first calibrating the switch 56 with the nut 102, and thereafter calibrating the switch 19 with the cam 54.

Alternatively, the calibration can be performed by first adjusting the cam 54 so as to establish a gaged distance between the end of the bumper 76 and the rib 82 at the time the switch 19 operates. Then the nut 102 is adjusted to calibrate the high limit switch 56. If the gaging adjustment of the cam 54 is correct, the adjustment of the nut 102 functions also to properly calibrate the switch 19.

If desired, the nut 102 may be replaced by a sleeve 105 which is welded to the end of the rod 17 after the rod and tube are moved relative to each other to the proper position for calibration, as illustrated in FIG. 4. Such system, because the sleeve 105 is adjusted to a proper position with respect to the rod before welding, provides adjustment or calibration of the high limit switch.

With the illustrated embodiment, it is not necessary to gage the device by the installation of bumpers having a length selected to provide a proper gaging for a particular assembly. Instead, such gaging or calibration, by the use of the cam 54, allows such operation to be performed after assembly.

It should also be noted that the bumper 76 is supported by the switch structures themselves rather than by the body 10. Referring to FIG. 3, the aperture 110 in the arm 36 through which the bumper 76 extends laterally locates the end of the bumper adjacent to the head 78 and the fixed contact support arm 57 is provided with an opening 111 which laterally positions and guides the end of the bumper at the end adjacent to the switch 56. The opening 112 in the wall 13 is sized so that the bumper does not engage the surface of such opening. With this structural arrangement for guiding the bumper 76, it is not necessary to form the opening 112 with the close tolerances which would be otherwise required. This is advantageous when the body is formed of a ceramic material which is costly to form with high dimensional precision. Further, since the switch 19 is normally open, the bumper is biased into engagement with the end of the rod. Therefore, the bumper is guided and positioned entirely by the switches and is free of any contact with the body 10.

The illustrated swivel structure also provides reduced cost when compared to the structures of the prior art illustrated in some of the patents cited above. The bearing member 97 can be formed as a simple stamping operation from sheet metal to reduce the costs thereof. Because the rod 17 is sized to fit through the opening 99 with a relatively close fit, any swiveling movement of the probe causes engagement of the rod 17 with the wall of the opening 99 and produces corresponding movement of the bearing member 97 with respect to the curved surface 94 so as to maintain proper alignment of the various parts. Further, since the opening 96 is formed with substantial clearance around the rod 17, such movement of the rod during the swiveling of the probe can be accommodated. Preferably, the radius of curvature of the curved portion 94 is selected so that the swiveling movement does not affect the calibration of the device to any appreciable extent.

With this invention, a combination thermostat which can be used, for example, as a hot light and high limit in a smooth top range can be accurately manufactured without selective fitting, and at relatively low cost. Further, because the switches are both snap-acting, radio interference does not present a problem. Still further, the switch 19, because of its structure, in which the actuation of the switch is applied at a point substantially remote from the mounting of the arm 36 and from the contacts 21 and 44, is not damaged even though it is subjected to substantial overtravel after closure. Consequently, the two switches can be calibrated to operate at widely different temperatures without presenting problems.

Although the preferred embodiment of this invention has been shown and described, it should be understood that various modifications and rearrangements of the parts may be resorted to without departing from the scope of the invention as disclosed and claimed herein.

What is claimed is:

1. A thermally responsive switching device comprising a body, a temperature probe providing a tube and a rod extending through said tube wherein said tube and rod are formed of material having different coefficients of thermal expansion, swivel means mounting one end of said tube on said body and permitting swiveling movement of said tube and rod relative to said body, said swivel means including a first member providing a curved surface which is a portion of a sphere, and a second member providing a circular surface engageable and movable along said curved surface, one of said members being supported by said body and providing a first central opening through which said rod projects with substantial clearance, the other of said members providing a second central opening through which said rod extends with relatively close clearance, said one end of said tube engaging a substantially flat portion of said second member around said second central opening, the other end of said tube being connected to said rod, spring means connected to said rod operating to tension said rod, bias said one end of said tube against said second member and in turn bias said second member against said first member, swiveling movement of said tubular member causing said rod to engage the sides of said second opening and in turn cause movement of said second member relative to said first member to maintain correct alignment of said second member with respect to said tube and rod, and switch means mounted on said body operated in response to differential thermal expansion and contraction of said rod and tube.

2. A switching device as set forth in claim 1, wherein said first and second members are formed from sheet metal and each have a substantially uniform thickness.

3. A switching device as set forth in claim 2, wherein said spring means includes a spring extending between on end of said rod and said one member to place said rod in tension and said tube in compression, and maintain said members in engagement.

4. A dual temperature thermostat comprising a body, first and second switches on said body, a differential expansion temperature sensing probe-type actuator mounted on said body providing an output portion movable relative to said body in response to temperature changes, a unitary switch operator movable by said output portion along a line of action by said probe actuator, said operator providing spaced first and second surfaces extending substantially perpendicular to the line of action, said first surface engaging and operating said first switch upon movement of said operator to a first position, said second surface engaging and operating said second switch upon movement of said operator to a second position, said operator being guided for movement along said line of action by said switches, said operator being elongated in the direction of said line of action, said first and second surfaces being spaced longitudinally along said operator, said first switch engaging said operator at one end and laterally supporting said one end, said second switch engaging said operator at the other end and operating to laterally support the other end thereof.

5. A dual temperature thermostat as set forth in claim 4, wherein one of said switches provides a resilient arm applying a spring force to said operator resiliently biasing said operator against said output portion.

6. A dual temperature thermostat as set forth in claim 5, wherein said switches are calibrated to operate at substantially different temperatures, and said resilient arm of said first switch is structured to withstand substantial overtravel.

7. A dual temperature thermostat as set forth in claim 4, wherein said body is a ceramic material capable of withstanding high temperatures.

8. A dual temperature thermostat comprising a body, first and second switches on said body, a differential expansion temperature sensing probe-type actuator mounted on said body providing an output portion movable relative to said body in response to temperature changes, a unitary switch operator movable by said output portion along a line of action by said probe actuator, said operator providing spaced first and second surfaces extending substantially perpendicular to the line of action, said first surface engaging and operating said first switch upon movement of said operator to a first position, said second surface engaging and operating said second switch upon movement of said operator to a second position, said operator being guided for movement along said line of action by said switches, said operator being elongated in the direction of said line of action, said first and second surfaces being spaced longitudinally along said operator, said first switch engaging said operator at one end and laterally supporting said one end, said second switch engaging said operator at the other end and operating to laterally support the other end thereof, said operator being free of contact with said body and being laterally positioned entirely by said switches.

9. A dual temperature thermostat comprising a body, first and second switches mounted on said body, a temperature sensing probe-type actuator mounted on said body and providing an output portion movable relative to said body in response to changes in temperature, a unitary switch operator movable by said output portion along a line of action, said operator providing spaced first and second surfaces extending substantially perpendicular to said line of action, said first surface engaging said operating said first switch upon movement of said operator to a first position, said second surface engaging and operating said second switch upon movement of said operator to a second position, said first switch providing first adjustment means for adjusting said first position without adjusting said second position, said probe providing a second adjustment for calibrating the operating temperature of said second switch.

10. A dual temperature thermostat as set forth in claim 9 wherein said probe is assembled to provide calibration of said second switch.

11. A dual temperature thermostat as set forth in claim 9, wherein said probe includes a tube and a rod extending through said tube, and said second adjustment is located at the end of said probe remote from said operating portion.

12. A dual temperature thermostat as set forth in claim 11, wherein said second adjustment is a nut threaded onto said rod and operable to adjust the position of said output portion relative to said body.

13. A dual temperature thermostat as set forth in claim 12, wherein said first switch is a snap-acting switch, and said first adjustment operates to adjust the snap position of said first switch.

14. A dual temperature thermostat as set forth in claim 13, wherein said first adjustment is a cam.

15. A thermally responsive switching device comprising a body assembly, a temperature probe assembly providing a tube and a rod extending through said tube wherein said tube and rod are formed of material having different coefficients of thermal expansion, swivel means mounting one end of said tube on said body assembly and permitting swiveling movement of said tube and rod relative to said body assembly, said swivel including a first part providing a curved surface which is a portion of a sphere and a second part engageable with said movable along said curved surface, one of said parts being provided by said body assembly and providing a first central opening through which said rod projects with substantial clearance, the other of said parts providing a second central opening through which said rod extends with a relatively close clearance, said one end of said tube engaging said second part around said central opening, the other end of said tube being connected to said rod, spring means connected to said rod operating to tension said rod, bias said one end of said tube against said second part, and in turn bias said second part against said first part, swiveling movement of said tube causing said rod to engage the sides of said second opening and to cause movement of said second part relative to said first part to maintin correct alignment of said second part with respect to said tube and rod, and switch means mounted on said body assembly operating in response to differential thermal expansion and contraction of said rod and tube.

16. A thermally responsive switching device comprising a body assembly, a temperature probe assembly providing a tube and rod extending through said tube wherein said tube and rod are formed of material having different coefficients of thermal expansion, swivel means mounting one end of said tube on said body assembly and permitting swiveling movement of said probe assembly relative to said body assembly, said swivel means including a first part which is part of said body assembly and provides a curved surface which is a portion of a sphere, and a second part which is part of said probe assembly and is engageable with said movable along said curved surface, said first part providing a first central opening through which said part projects with substantial clearance, said second part providing a second central opening through which said rod extends with relatively close clearance, the other end of said tube being connected to said rod, spring means connected to said rod operating to tension said rod and bias said tube toward said body assembly, swiveling movement of said tube causing said rod to engage the sides of said probe assembly to maintain correct alignment of said second part with respect to said rod, and switch means mounted on said body assembly operated in response to differential thermal expansion and contraction of said rod and tube.

17. A dual temperature thermostat comprising a body, first and second switches on said body, a different expansion temperature sensing probe-type actuator mounted on said body providing an output portion movable along a line of action relative to said body in response to temperature changes, a unitary switch operator, said operator being elongated in the direction of said line of action and providing first and second surfaces extending substantially perpendicular to said line of action and spaced longitudinally along said operator in the direction of said line of action, said switch operator being movable by said output portion along said line of action, and first surface engaging and operating said first switch upon movement of said operator to a first position, said second surface engaging and operating said second switch upon movement of said operator to a second position.

18. A dual temperature thermostat comprising a body, first and second switches mounted on said body, a temperature sensing probe-type actuator mounted on said body and providing an output portion movable relative to said body along a line of action in response to changes in temperature, a unitary switch operator movable by said output portion along said line of action, said operator being elongated in the direction of said line of action and providing first and second surfaces spaced relative to each other along said line of action and extending substantially perpendicular thereto, said first surface engaging and operating said first switch upon movement of said operator to a first position, said second surface engaging and operating said second switch upon movement of said operator to a second position, said probe providing an adjustment for calibrating the position of said operator at predetermined operating temperatures.

* * * * *

UNITED STATES PATENT AND TRADEMARK OFFICE

CERTIFICATE OF CORRECTION

PATENT NO. : 4,604,603

DATED : August 5, 1986

INVENTOR(S) : Donald E. Place

It is certified that error appears in the above—identified patent and that said Letters Patent is hereby corrected as shown below:

Column 1, line 24, "is" should read as --it--.

Column 1, line 49, "the" should read as --tube--.

Column 2, line 52, "centrl" should read as --central--.

Column 4, line 40, "70" should read as --79--.

Column 4, line 47, "16" should be inserted after --mounting--.

Column 9, claim 15, line 29, "said" should read as --and--.

Column 10, claims 17 and 18 should be cancelled.

Add the following claim.

--19. A dual temperature thermostat comprising a body assembly, first and second switches on said body assembly, a differential expansion temperature sensing probe-type actuator, swivel means mounting one end of said probe-type actuator on said body assembly and permitting swiveling movement of said probe-type actuator relative to said body assembly, said swivel means including a first part which is part of said body assembly and provides a curved surface which is substantially a portion of a sphere and a second part which is part of said probe assembly and is engageable with and movable along said curved surface, said probe-type actuator providing an output portion movable along a line of action relative to said body in

UNITED STATES PATENT AND TRADEMARK OFFICE

CERTIFICATE OF CORRECTION

PATENT NO. : 4,604,603

DATED : August 5, 1986

INVENTOR(S) : Donald E. Place

It is certified that error appears in the above-identified patent and that said Letters Patent is hereby corrected as shown below:

response to temperature changes, a unitary switch operator, said operator being elongated in the direction of said line of action and providing first and second surfaces extending substantially perpendicular to said line of action and spaced longitudinally along said operator in the direction of said line of action, said switch operator being movable by said output portion along said line of action, said first surface engaging and operating said first switch upon movement of said operator to a first position, said second surface engaging and operating said second switch upon movement of said operator to a second position, the curvature of said curved portion being selected so that the swiveling movement does not effect the calibration of the thermostat to any appreciable extent.--

Signed and Sealed this

Third Day of March, 1987

*Attest:*

DONALD J. QUIGG

*Attesting Officer*

*Commissioner of Patents and Trademarks*